US007334319B2

(12) United States Patent
Kusserow et al.

(10) Patent No.: US 7,334,319 B2
(45) Date of Patent: Feb. 26, 2008

(54) METHOD FOR OPENING THE CONTACT GAP OF A VACUUM INTERRUPTER

(75) Inventors: Joerg Kusserow, Neuenhagen (DE); Roman Renz, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 357 days.

(21) Appl. No.: 10/311,960

(22) PCT Filed: Jun. 6, 2001

(86) PCT No.: PCT/DE01/02126

§ 371 (c)(1),
(2), (4) Date: Aug. 13, 2003

(87) PCT Pub. No.: WO01/99133

PCT Pub. Date: Dec. 27, 2001

(65) Prior Publication Data

US 2004/0124178 A1 Jul. 1, 2004

(30) Foreign Application Priority Data

Jun. 20, 2000 (DE) ..... 100 30 187

(51) Int. Cl.
*H01H 11/00* (2006.01)
*H01H 65/00* (2006.01)

(52) U.S. Cl. ..... 29/622; 29/874; 29/876; 200/82 B; 200/238; 218/118; 218/123

(58) Field of Classification Search ..... 29/622, 29/874, 876; 200/82 B, 238; 218/118, 123
See application file for complete search history.

(56) References Cited

U.S. PATENT DOCUMENTS

| | | | | |
|---|---|---|---|---|
| 2,534,933 | A | | 12/1950 | van Sickle |
| 3,586,803 | A | * | 6/1971 | Horn et al. ..... 218/133 |
| 4,063,991 | A | * | 12/1977 | Farrall et al. ..... 216/97 |
| 4,901,251 | A | | 2/1990 | Sfarti |
| 5,521,569 | A | | 5/1996 | Blochouse |

FOREIGN PATENT DOCUMENTS

| | | |
|---|---|---|
| DE | 27 02 962 | 7/1978 |
| DE | 38 15 805 | 11/1989 |
| DE | 40 06 452 | 9/1991 |
| DE | 195 19 078 | 11/1996 |

* cited by examiner

*Primary Examiner*—A. Dexter Tugbang
*Assistant Examiner*—Tim Phan
(74) *Attorney, Agent, or Firm*—Laurence A. Greenberg; Werner H. Stemer; Ralph E. Locher

(57) ABSTRACT

The aim of the invention is to improve the breaking ability of vacuum interrupter in the medium- and high-voltage range. Said aim is achieved whereby the contact pieces which may be displaced relative to each other are moved with a relatively high speed during a first phase (S1) of the separation process until about ¼ to ½ of the ultimate separation (extinction stroke Eh) and are brought to the given ultimate separation (isolating stroke Eh) during a second phase (S2) with relatively low speed.

3 Claims, 1 Drawing Sheet

METHOD FOR OPENING THE CONTACT GAP OF A VACUUM INTERRUPTER

CLAIM FOR PRIORITY

This application is a national stage of PCT/DE01/02126, published in the German language on Dec. 27, 2001, which claims the benefit of priority to German Application No. DE 100 30 187.8, filed on Jun. 20, 2000.

TECHNICAL FIELD OF THE INVENTION

The invention relates to the field of electrical switches, and in particular to the operation of vacuum interrupters.

BACKGROUND OF THE INVENTION

In electrical switches which contain a vacuum interrupter as the actual switching element, a drive linkage is provided for moving the switching contact piece which can be moved and is electrically connected to the exterior via a current supply bolt, which drive linkage acts on the moveable switching contact piece via a contact compression spring during the connection process and, during disconnection—after traveling through a certain acceleration distance—drives the moving switching contact piece suddenly. In order to stabilize the intrinsic high disconnection rating of such vacuum interrupters or such vacuum interrupters which are provided with radial field or axial field contact pieces, it is known for the moveable switching contact piece to be influenced directly after contact disconnection such that the contact gap is opened by at least 1 mm after at the latest 1.3 ms, that is to say for the moveable switching contact piece to be given a high initial acceleration. In the case of radial field contact pieces, it has been found to be advantageous for a contact piece disconnection speed of 2 m/s to be achieved after 0.8 ms. With this known influence on the time sequence of the opening of the contact gap, the disconnection speed of the moveable switching contact piece is essentially constant over the entire contact travel, apart from the phase of the high initial acceleration and the severe braking on reaching the full contact travel (DE 38 15 805 C2).

Furthermore, a high-voltage vacuum switch is known, in which the contact travel is subdivided by means of a special design configuration of the vacuum interrupter into three sections which are referred to as "functional stages" (the switching travel, a first stage of the isolating travel and a second stage of the isolating travel). The special design configuration comprises the association of in each case one potential ring with each contact piece and an axially moveable arrangement of the housing of the vacuum interrupter with respect to the stationary switching contact piece. These measures mean that the two switching contact pieces are located in the field shadow of the respective potential ring when the moving switching contact is in the off position, thus improving the isolation capability of the vacuum interrupter for a given contact separation (DE 195 19 078 A1).

SUMMARY OF THE INVENTION

Brief Description of the Drawings

The invention is described in more detail below with reference to the drawings, in which.

DETAILED DESCRIPTION OF THE INVENTION

Figure 1:
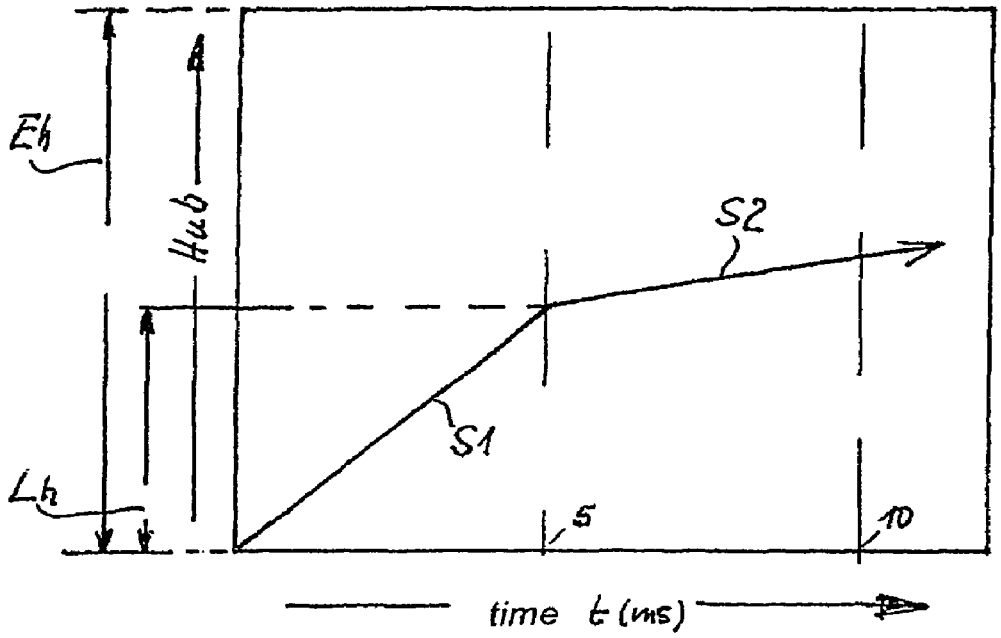
FIG. 1 shows the switching travel plotted against time in accordance with the invention.

Against the background of a method for opening the contact gap in a vacuum interrupter which is designed for an operating voltage of at least 12 kV and which has two switching contact pieces in a housing, which can be moved relative to one another and are electrically connected to the exterior via current supply bolts (DE 38 15 805 C2), the invention further improves the disconnection capacity by specific action on the time sequence of the disconnection characteristic.

In one embodiment of the invention, there is a first phase of the disconnection movement which is used for current quenching, the contact pieces are moved at a first speed to a contact separation of about ¼ to ½ of a predetermined final separation, and that in a second phase of the disconnection movement which is used for voltage isolation, the contact pieces are moved at a second speed to a predetermined final separation, with the first speed being greater than the second speed. The first speed is expediently at least three times the second speed.

With a procedure such as this, the disconnection process is subdivided by means of time sequencing of a first section with a high switching speed and a second section with a slow switching speed into the functions of "current quenching/quenching travel" and "voltage isolation/isolating travel", in which case the quenching travel should be chosen such that the switching arc is reliably quenched with a time of 2 to 15 ms at the next current zero crossing. The contact gap is then opened to the switching contact piece separation that is required dielectrically. This procedure is based on the knowledge that the disconnection capacity rises as the disconnection speed increases, and that—especially in the case of radial field but also in the case of axial field contacts—the disconnection capacity becomes greater than the shorter of the switching travel and the quenching travel. In this case, a lower limit is set for the switching travel by the required dielectric strength of the contact gap. The invention also takes account of the knowledge that, during a switching process, the dielectric recovery of the conventional contact materials, in particular of CuCr, that is the time to return to the dielectric strength provided in the cold state, takes place within a few microseconds during the switching process, in which case, for medium-voltage vacuum interrupters (≦36 kV), these dielectric strengths above the maximum return voltages (≧60 kV) are reached just by a contact travel of 2 mm (after the current zero crossing). The dielectric recovery of the contact gap after the current zero crossing thus takes place considerably more quickly than the rise in the returning voltage. In consequence, the dielectric strength during the quenching travel is always greater than the transient return voltage associated with the respective voltage level. The matching of the dielectric field strength of the contact gap to the mains condition, in particular to the lightning surge withstand voltage, then takes place at a greatly reduced speed, by further increasing the contact travel.

The splitting of the switching process in time into a quenching travel and an isolating travel with a different rate of travel and, in general, also with a different travel length needs to be chosen differently for vacuum interrupters in the medium-voltage range and in the high-voltage range (</>56 kV). For vacuum interrupters which are provided with radial field contacts or with magnetic field contacts and are designed for an operating voltage of 12 to 36 kV, it has been found to be expedient to use a design on the basis of which the first speed is about 0.5 to 2 m/s and the second speed is about 0.1 to 0.3 m/s. In this case, the quenching travel is about 3 to 5 mm, and the total contact travel is about 8 to 20 mm.

For vacuum interrupters which are fitted with axial magnetic field contacts and are designed for an operating voltage of more than 52 kV, for example 72 kV, it has been found to use dimensions on the basis of which the first speed is about 1 to 3 m/s and the second speed is about 0.1 to 0.3 m/s. In this case, the quenching travel is about 20 mm, and the total contact travel is about 40 to 60 mm.

The two speeds during the opening of the contact gap can be achieved in various ways. By way of example, damping elements can be inserted into previously normal drive mechanisms. FIG. 2 shows one example of this. However, the drive can also be designed by means of appropriate cam disks such that the moveable switching contact is positively controlled by means of one cam disk. Such control is disclosed in principle in FIGS. 1 and 2 of DE 27 02 962 A1. One particularly expedient possible way to produce the two speeds, according to a further embodiment to the invention, is for the two switching contact pieces to be moved in opposite senses, with the first switching contact piece being moved at the first speed during the first phase of the disconnection movement, and with the other switching contact piece being moved at the second speed during the second phase of the disconnection movement, or else during both the first and the second phases of the disconnection movement. In the case of medium-voltage vacuum interrupters, the contact piece which is moved faster therefore needs to move only through a travel of 2 to 5 mm, while the contact piece which moves more slowly moves only through the further travel of about 6 to 15 mm, or through the total travel of 8 to 20 mm. In the case of vacuum interrupters for high-voltage purposes, the contact piece which moves more quickly moves through the quenching travel of about 10 to 20 mm, and the contact piece which moves more slowly has to move through the further travel of 20 to 40 mm, so that the total travel is 40 to 60 mm. U.S. Pat. No. 4,901,251 A1 discloses a vacuum interrupter having two contact pieces which can be moved in opposite senses.

Figure 2:
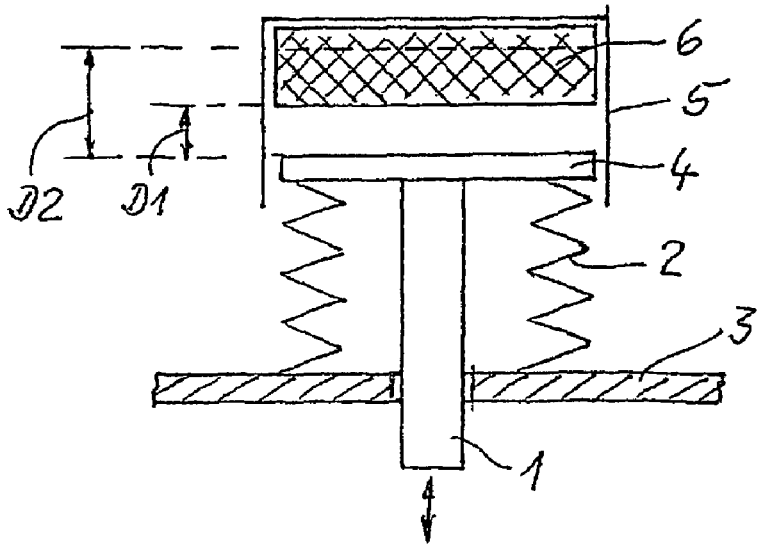
FIG. 2 shows how damping elements can be inserted into normal drive mechanisms according to an embodiment of the invention.

In order to explain the new method, FIG. 1 shows a diagram which illustrates the switching travel plotted against time.

The contact gap is opened in two sections S1, S2, which are shown as straight lines with different gradients. The straight line S1 indicates that the quenching travel Lh is reached after a time T1 which, by way of example, is 5 ms when the disconnection speed of the contact pieces is 1 m/s and the quenching travel is 5 mm.—The straight line S2 indicates that the final travel Eh is reached after a time t1 plus t2 which, by way of example is about 100 ms for a disconnection speed of 0.2 m/s and a final travel of 20 mm.

According to FIG. 2, a drive rod 1, which is coupled in a manner that is not illustrated in any more detail to the moveable contact piece of a vacuum interrupter, has an associated disconnection spring 2 which—supported on a board 3—acts via a plate 4 on the drive rod 1. The plate 4 is at the same time part of a damping arrangement, which also includes a pot 5 and a damping element 6 arranged in the pot. During a disconnection movement, the plate 4 first of all moves without any impediment into the pot 5 until it reaches a depth D1 which corresponds to the quenching travel of the associated vacuum interrupter. There, the plate 4 meets a compressible damping element 6, as a result of which the speed at which the plate 4 continues to enter the pot 5 is correspondingly reduced until it reaches the position D2, which corresponds to the final travel of the vacuum interrupter.

The invention claimed is:

1. A method for opening a contact gap in a vacuum interrupter, which operates at a voltage of at least 12 kV and which has two switching contact pieces in a housing, which switching contact pieces can move relative to one another and are electrically connected to an exterior via current supply bolts, comprising:

moving the contact pieces at a first speed to a contact separation of about ¼ to ½ of a predetermined final separation, in a first phase of the disconnection movement used for current quenching;

moving the contact pieces at a second speed to a predetermined final separation, with the first speed being at least three times greater than the second speed, in a second phase of the disconnection movement used for voltage isolation;

fitting the vacuum interrupters with axial magnetic field contacts and operating the vacuum interrupters at a voltage of more than 52 kV, and the first speed being about 1 to 3 m/s and the second speed being about 0.1 to 0.3 m/s; and moving the two switching contact pieces in opposite senses, with the first switching contact piece being moved at the first speed during the first phase of the disconnection movement, and the other switching contact piece being moved at the second speed during the first and the second phase of the disconnection movement.

2. The method as claimed in claim 1, wherein the vacuum interrupters are provided with radial field contacts and operate at a voltage of 12 to 36 kV, and the first speed is about 0.5 to 2 m/s, and the second speed is about 0.1 to 0.3 m/s.

3. The method as claimed in claim 1, wherein the disconnection movement is carried out by moving one of the two switching contact pieces, with damping forces acting on the drive system for movement of the switching contact piece to produce the second phase of the disconnection movement.

* * * * *